US005918806A

United States Patent [19]

Keightley et al.

[11] Patent Number: 5,918,806

[45] Date of Patent: Jul. 6, 1999

[54] ELECTRICALLY INSULATED RAILWAY CROSS TIE

[75] Inventors: Sean Keightley, Garibaldi Highlands; Joseph David Sowden Broadbent, Surrey; Robert Scott Johnston; Brent Andrew Jarvis, both of Garibaldi Highlands, all of Canada

[73] Assignee: North American Steel Tie Corp., Surrey, BC, Canada

[21] Appl. No.: 08/853,064

[22] Filed: May 8, 1997

[51] Int. Cl.[6] ..... E01B 9/34

[52] U.S. Cl. ..... 238/108

[58] Field of Search ..... 238/37, 45, 62, 238/107, 108

[56] References Cited

U.S. PATENT DOCUMENTS

| | | | |
|---|---|---|---|
| 1,117,100 | 11/1914 | Sipchen et al. | 238/108 |
| 1,173,844 | 2/1916 | Munslow | 238/108 |
| 1,242,334 | 10/1917 | Eddy | 238/108 |
| 1,259,755 | 3/1918 | Lockard | 238/108 |
| 3,808,425 | 4/1974 | Campbell et al. | 246/8 |
| 3,811,593 | 5/1974 | Bridges et al. | 220/11 |
| 3,955,761 | 5/1976 | Szarka et al. | 238/8 |
| 4,061,270 | 12/1977 | Wandrisco | 238/107 |

*Primary Examiner*—S. Joseph Morano
*Attorney, Agent, or Firm*—Chernoff, Vilhauer, McClung & Stenzel

[57] ABSTRACT

The invention is an electrically insulated steel railway cross tie for use with railway tracks using track circuit systems. The electrically insulated steel cross tie prevents the cross tie for shorting the track circuit systems. A method of manufacturing the electrically insulated steel cross tie is to transversely cut an uninsulated steel cross tie into separate elongated members. The elongated members are then re-joined end to end with an insulator member interposed between the elongated members. The insulator member prevents electrical current from being conducted from one elongated member to another elongated member. In the preferred embodiment end plates are welded to the cut ends of the elongated members and bolts are used to releasably join the elongated members together. The bolts are electrically insulated to prevent the bolts from conducting electrical current between the elongated members.

22 Claims, 10 Drawing Sheets

ELECTRICALLY INSULATED RAILWAY CROSS TIE

FIELD OF THE INVENTION

The invention relates to electrically insulated railway cross ties for installation on railway tracks where the stock rails must be electrically insulated from one another. In particular, the electrically insulated cross ties of the invention are useful where track electrical circuit signal systems are installed.

BACKGROUND OF THE INVENTION

Steel railway cross ties have been used for over a hundred years. Cross ties made from steel have always had to compete against cross ties made from other materials such as timber or reinforced concrete. In the early part of the 20th century railway companies began treating timber cross ties with creosote. The creosote treatment improved the service life of timber cross ties and some railway companies began to favor using creosote treated timber cross ties over steel cross ties.

Current economic factors, including a declining cost differential between timber and steel, have made many railway companies reconsider using steel cross ties as an economically viable alternative to timber cross ties. This is particularly true when railway companies consider the longer service life of steel cross ties and the totality of costs over the entire service life of the cross ties. Steel cross ties also have a number of performance advantages over timber cross ties and reinforced concrete cross ties.

Some of the benefits and advantages of steel cross ties alluded to above are set out below:

a. Steel cross ties are lighter than concrete or timber cross ties so more steel cross ties can be shipped on a 100 ton capacity rail car, thereby reducing transportation costs.

b. Steel cross ties have a lower profile than concrete or timber cross ties, so steel cross ties require approximately 500 to 700 cubic yards less ballast per mile.

c. Because steel cross ties are lighter than concrete or timber cross ties and requires less ballast, this reduces the dead load that must be supported by bridges and foundations for railway tracks.

d. Steel cross ties have a larger footprint than either concrete or timber cross ties, so steel cross ties can be spaced at greater center to center distances than timber cross ties while allowing greater load spreading capabilities.

e. Steel cross ties have a better derailment survivability record compared to concrete or timber cross ties.

f. Steel cross ties are not prone to deterioration like timber or concrete cross ties around fuelling facilities.

g. Steel cross ties are more forgiving compared to timber or concrete cross ties under adverse conditions such as center bound track or poor surface conditions where surfacing programs have been cancelled or delayed.

h. Steel ties require less material handling than timber ties with no tie plates, anchors or spikes to distribute.

i. Steel cross ties can be handled manually or with existing maintenance equipment and tools.

j. Steel cross ties can be installed with a Track Renewal Machine or mechanized tie gang.

k. Steel cross ties have a longer service life than timber cross ties.

l. Steel cross ties can be recycled.

Despite all of the above-noted benefits and advantages, a longstanding drawback of steel cross ties is that they can not be directly substituted for timber cross ties where there are electrical signal systems which use track electrical circuits. Approximately twenty percent of the total track mileage in North America has signal systems using track circuits. A track circuit uses the stock rails as the conductors and the train wheels and axles as the switch for activating signals when shorted. Unlike timber cross ties, steel cross ties conduct electricity. Therefore, steel cross ties installed on tracks using track circuits must be electrically insulated to prevent the cross ties from completing the track circuit.

One method of electrically insulating steel cross ties is to use a sandwich plate construction on top of the steel cross tie. According to this method, an insulating layer is sandwiched between the top of the steel tie and a protective load-distributing cover plate. The stock rails are affixed to the cover plate, and the cover plate is attached to the cross tie by an electrically insulated fastener. In a common arrangement, one set of bolts with electrically insulated sleeves are used to hold together the steel cover plate, the electrical insulating layer, and the steel cross tie. A second set of bolts mounts the clips and other hardware used for anchoring the stock rail to the cover plate.

A problem with using a sandwich plate construction is that the cover plate needs to be thick enough to carry the load without warping or tearing. The cover plate adds substantially to the weight and cost of this method of electrically insulating steel cross ties. Also, the plates and bolt hole configurations have to be custom fabricated for the particular layout of each turnout. Finally, if existing uninsulated steel cross ties are to be converted to electrically insulated steel cross ties, the conversion process using sandwich plate construction is complicated. Riser plates must be machined off, and the existing bolt holes in the steel cross ties need to be filled and new holes drilled or punched.

Another method of electrically insulating steel cross ties is to surround the stock rail with an insulating element where it is in contact with the cross tie. An example of this solution is disclosed by Wandrisco in U.S. Pat. No. 4,061,270 ("Wandrisco"), issued to United States Steel Corporation on Dec. 6, 1977. Wandrisco teaches a saddle-type insulating element for use with a steel cross tie which permits the stock rail to be used as an on-line signal control conveying device.

There are also problems associated with the solution taught by Wandrisco. First, this approach, like the sandwich plate arrangement, adds an electrically insulating layer between the stock rails and the cross ties. The additional thickness of the electrically insulating saddle may require non-standard clips and rail braces which can accommodate the extra insulating layer.

Another problem with saddle-type electrical insulators is that a large number of specially shaped saddles would be required to electrically insulate the cross ties used for a turnout. For example, the cross ties underneath the frog and switch areas would require a large number of insulating saddles with varying widths or shapes to accommodate the close proximity of the stock rail with other components and mounting hardware. The need for a variety of shapes and sizes of insulator pieces requires railway companies to keep a larger inventory of spare parts on hand for maintenance and new construction.

A problem with any electrically insulated steel cross tie which uses an insulating layer between the stock rail and the cross tie is that the insulating layer and protective plates, if any, increase the overall depth required to install the cross tie and the additional layers. Depending on the thickness of the added layers, this could complicate the conversion of an uninsulated switching area to an electrically insulated switching area.

Accordingly, there is a need for an electrically insulated steel cross tie which does not insert insulating layers between the stock rails and the cross ties, thereby avoiding many of the problems associated with sandwich plate arrangements and saddle-type insulators such as the ones described above.

SUMMARY OF THE INVENTION

This invention relates to a novel electrically insulated railway cross tie for use with a railway track system.

The electrically insulated cross tie of the invention is particularly useful when installed on a railway track which uses a track electrical circuit system. The electrically insulated steel cross tie of the invention, prevents the cross tie for shorting the track electrical circuit system.

The invention adopts a novel approach to this problem. Whereas the prior art taught electrically insulating the stock rails from standard cross ties by inserting an insulating layer between the stock rails and unmodified standard cross ties, the invention teaches a method of modifying the cross ties to prevent the cross tie from conducting electrical current between spaced stock rails. This novel approach preserves the standard arrangement used for anchoring stock rails to cross ties.

The insulated cross tie according to the invention comprises a first elongated member and a second elongated member with a longitudinal axis aligned with the first member. An electrically non-conductive insulator member is associated with the first and second elongated members. The insulator member electrically insulates the first elongated member from the second elongated member.

Conveniently, the insulator member is positioned between the first and second elongated members. An insulated connector releasably joins the first and second members together into a unitary cross tie with the insulator member electrically isolating the first and second members from each other.

The first and second elongated members can be made from steel or other electrically conductive metals selected according to criteria such as the operating conditions, economic factors, and availability.

In one embodiment the insulated connector comprises a bolt inserted through aligned bolt holes in the first elongated member, the insulator member, and the second elongated member. Bolts extend through the bolt holes and a locking nut is fitted on the threaded end of the bolt. An electrically insulating sleeve with a flange, prevents the bolt or nut from contacting the first or second elongated members, preventing the bolt from conducting electrical current from one elongated member to another.

In a second embodiment, the electrically insulating sleeve lines the bolt holes and the sleeves are part of a larger inner insulator piece. The inner insulator piece covers the inside surface of the end plates of the respective first and second members preventing the bolt heads, washers and nuts from contacting the end plates.

In the preferred embodiment, the components of the electrically insulated connector are all arranged inside an area defined by the cross section of the first and second elongated members.

A method of manufacturing the preferred embodiment of the insulated steel cross tie is to transversely cut an uninsulated steel cross tie into separate elongated members. The elongated members are then re-joined end to end with an insulator member interposed between the elongated members. The insulator member prevents electrical current from being conducted from one elongated member to another elongated member. In the preferred embodiment end plates are welded to the cut ends of the elongated members and bolts are used to releasably join the elongated members together. Insulating sleeves are used to prevent the bolts from conducting electrical current between elongated members.

There are a number of advantages which result from this approach. For example, if one part of the cross tie is damaged by a derailment, then it is only necessary to replace the damaged part of the cross tie. An uninsulated steel cross tie turnout set can be easily converted to an insulated turnout by removing the cross ties, cutting them into separate elongated members, splicing them together with an insulating barrier therebetween, and then returning the insulated cross tie to service on the same railway track. Alternatively, new insulated steel cross ties according to the invention, could be directly substituted for existing timber or reinforced concrete cross ties.

In developing this invention, several methods of joining the two steel halves of the cross tie into a unitary steel member were studied. A sandwiched splice and an outside flanged butt splice were both studied, but these methods showed weaknesses in bending and repetitive load fatigue. An outside flanged butt splice results in a very stiff tie section which subjects the bolts to tremendous forces. With an outside flanged butt splice it was found that the joint projects upward. An outside flanged butt splice also positioned the flange and bolts where they would be susceptible to damage and where such protrusions would also be a tripping hazard.

An inside insulated butt joint according to the preferred embodiment of the invention solves a number of technical and operating problems in the use of insulated steel turnout tie sets. For example, an inside insulated butt joint can be designed to satisfy operational requirements for repetitive load fatigue and load handling capability. Also, the joint is less susceptible to derailment damage since the majority of the joint is concealed beneath the top surface of the cross tie.

Insulated steel cross ties made according to the invention have the same exterior dimensions and shape as uninsulated steel cross ties.

The insulated steel cross tie according to the invention has only a limited number of replaceable items. A railway company would only need to keep an inventory of insulator pieces and bolts with nuts and washers. The cross ties and end plates are not wear components.

BRIEF DESCRIPTION OF THE DRAWINGS

The drawings of the invention illustrate specific embodiments of the invention, but should not be construed as restricting the spirit or scope of the invention in any way.

Reference numbers used to identify certain components have been used to identify the same components in all of the Figures.

DETAILED DESCRIPTION OF THE PREFERRED EMBODIMENT

The invention is an electrically insulated steel railway cross tie for installation on railway tracks using track circuit signal systems.

Figure 1:
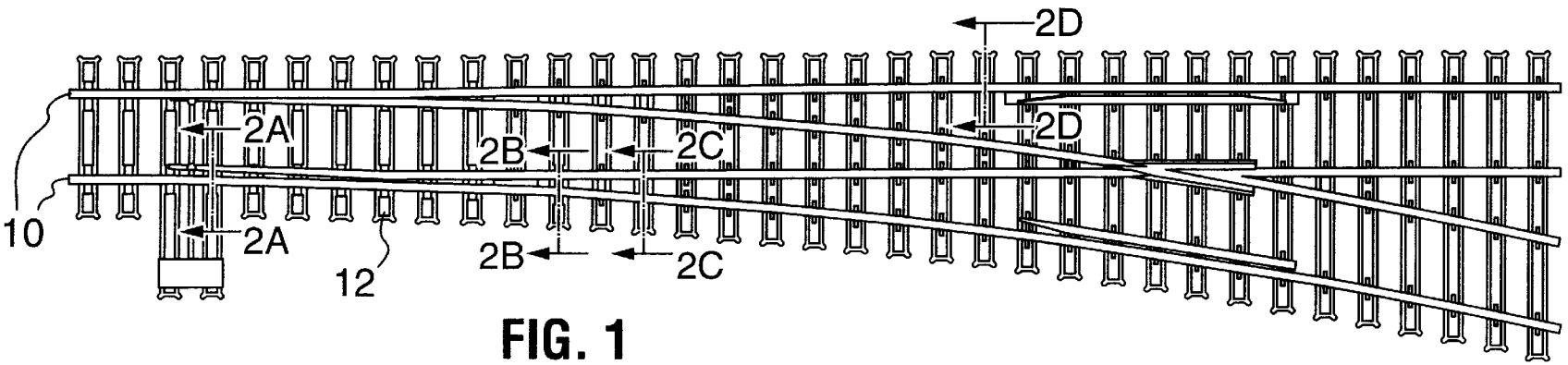
FIG. 1 PRIOR ART
FIG. 1 is a plan view of a turnout according to the prior art.

FIG. 1 depicts a plan view of a typical turnout according to the prior art. The plan view of an uninsulated turnout and an insulated turnout according to the prior art appears the same because the electrical insulation is underneath the stock rails (10), isolating the stock rails (10) from the standard unitary steel cross ties (12). The standard unitary steel cross ties (12) are the same for insulated and uninsulated turnouts according to the prior art. FIG. 1 shows how the location of the stock rails (10) on the standard unitary cross ties (12) varies, as does the contact area of the stock rails (10) and related components on the standard cross ties (12). These variables are governed by a number of factors, such as the location on the turnout, and the layout of a given turnout.

For example there is significant variation in the contact areas between the stock rails (10) and the standard unitary cross ties (12) where the stock rails (10) converge at the switching and crossing areas. The operating conditions and physical arrangement of the components at the point of the switch or the heel of the switch or at the crossing area may dictate different means of insulating the stock rails (10) from the standard cross ties (12) using the methods of the prior art.

The layout of the turnout varies depending on the constraints of a given site. The overall length of the turnout section and the sharpness of the turnout adds to the complexity of the problem. Therefore, standardization of insulating components for use on turnouts has been difficult using the methods taught by the prior art.

FIGS. 2*a* through 2*d* are sectional views which show various railway track components and stock rail (10) configurations which are required in a typical turnout and typical means taught by the prior art of insulating the stock rails (10) from the standard cross ties (12). Using the prior art methods, insulating standard steel cross ties (12) at turnouts must normally be done on a custom "made to order" basis.

Figure 2A:
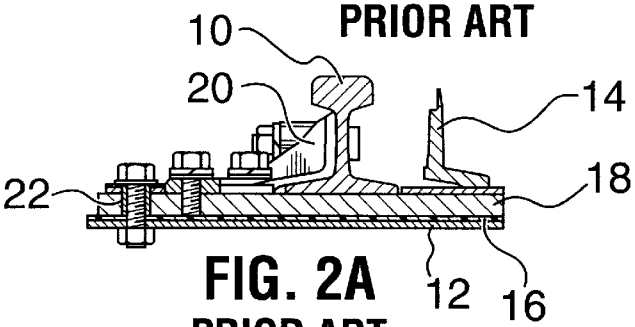
FIG. 2A PRIOR ART
FIGS. 2*a* through 2*d* are cross sections of the prior art methods for electrically insulating steel cross ties.

FIG. 2*a* is a sectional view of the switch area seen through the section marked 2A—2A in FIG. 1. The switch-blade (14) moves against the stock rail (10) when the switch is activated. FIG. 2*a* depicts a sandwich plate construction with the insulating layer (16) being a high density polyethylene sheet. The insulating layer (16) is positioned between the top of the standard cross tie (12) and a thick metal cover plate (18). The stock rail (10) is attached to the cover plate (18) by bolts and a standard brace (20). The cover plate (18) is anchored to the standard cross tie (12) by bolts insulated from the cover plate by a flanged insulating sleeve (22). A nut is welded to the underside of the standard cross tie (12) to receive the bolt.

Figure 2B:
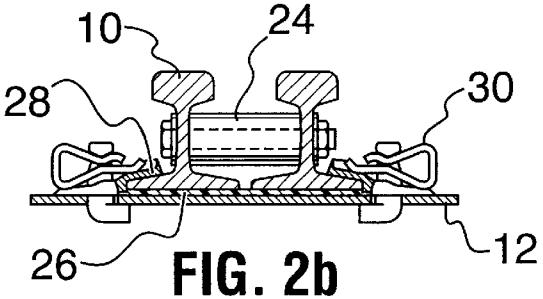
FIG. 2b PRIOR ART

FIG. 2*b* is a sectional view of the section marked 2B—2B in FIG. 1. FIG. 2*b* shows an arrangement which is typical for the heel of the switch and the guard rails. A stock rail web spacer (24) is affixed by bolts. The arrangement at the crossing is similar to the arrangement depicted by FIG. 2*b*. A high density polyethylene sheet (26) is laid between the standard cross tie (12) and the stock rails (10). An insulation insert (28) is positioned between the flange of the stock rail (10) and the clip (30).

Figure 2C:
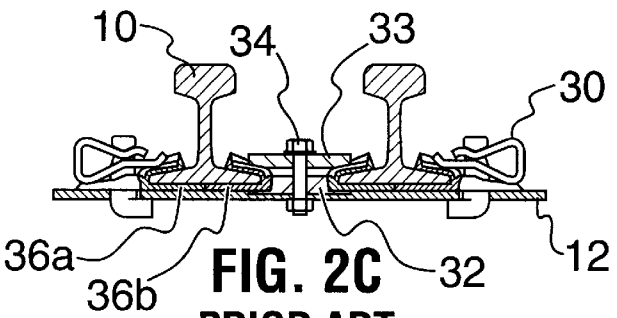
FIG. 2C PRIOR ART

FIG. 2*c* is a sectional view of the section marked 2C—2C in FIG. 1. FIG. 2*c* shows a different insulating arrangement for stock rails (10) which are spaced further apart. In this arrangement, spacer (32), clamp plate (33) and clamp bolt (34) are used to maintain the spacing of the stock rails (10). FIG. 2*c* depicts a two piece insulator (36*a*, 36*b*) . The two pieces of the insulator (36*a*, 36*b*) overlap one another underneath the stock rail (10).

Figure 2D:
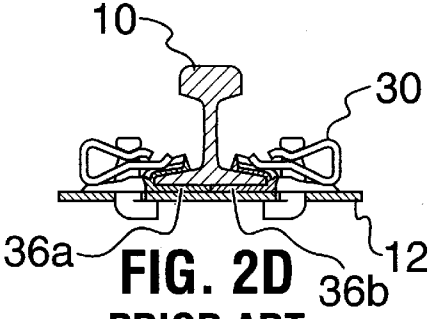
FIG. 2D PRIOR ART

The same arrangement is depicted in FIG. 2*d* which is a sectional view of the section marked 2D—2D in FIG. 1. FIG. 2*d* depicts the arrangement where only one stock rail (10) is insulated. The installed two piece insulator (36*a*, 36*b*) overlaps the flanges of the stock rail (10) and the insulator (36*a*, 36*b*) is retained there by clips (30).

Figure 3:
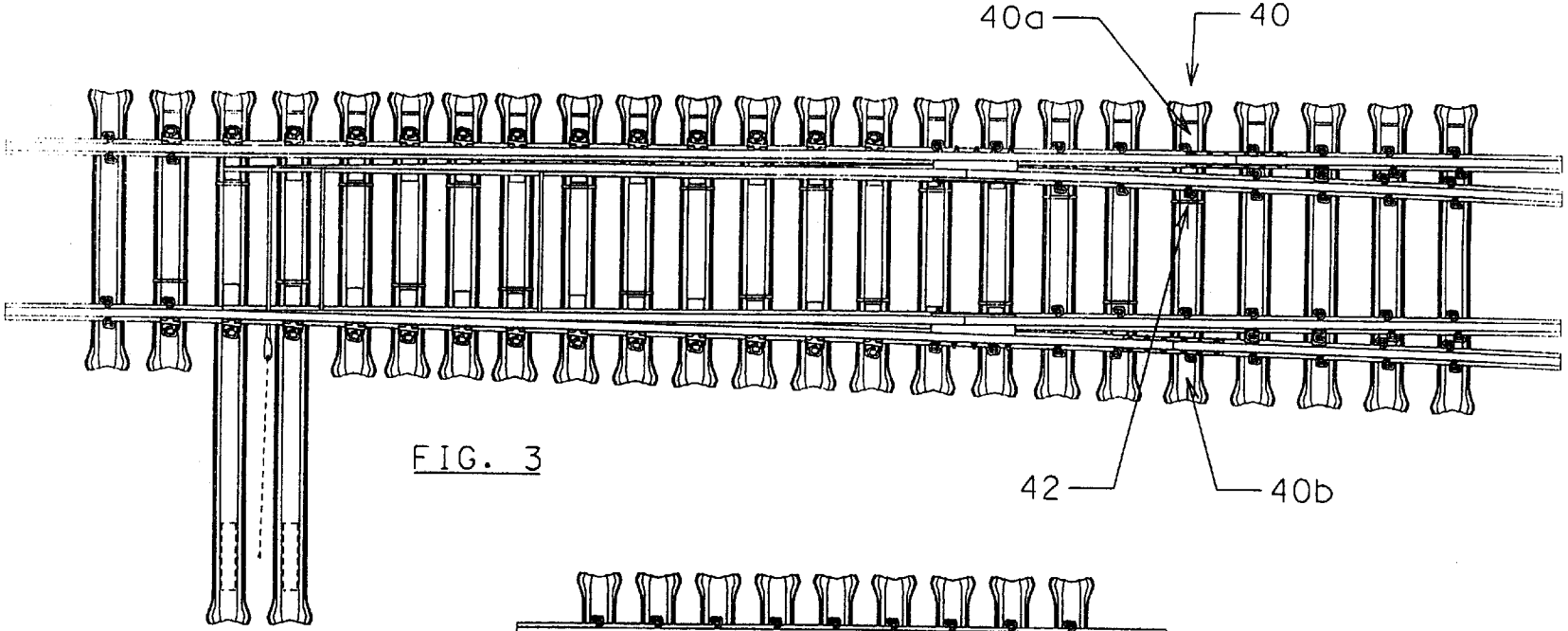
FIG. 3 is a plan view of a switch area with electrically insulated steel cross ties according to an embodiment of the invention.

FIG. 3 is a plan view of a switch area with insulated steel cross ties (40) according to an embodiment of the invention. Compared to the prior art, by using segmented non-unitary steel cross ties (40), the invention takes a different approach to solving the problem of electrically insulating steel cross ties (40). The invention teaches cross ties made from a plurality of elongated members (40*a*, 40*b*) joined end to end at insulated joints (42) so the members (40*a*, 40*b*) are electrically insulated from each other. This is different from the prior art which teaches using continuous standard unitary cross ties (12) which are insulated from the stock rails (10) at the contact areas between the standard unitary cross ties (12) and the stock rails (10). Accordingly, one of the advantages of the insulated cross ties (40) taught by the invention is that the same components and mounting holes can be used for insulated and non-insulated standard steel cross ties (12, 40). This is an advantage when converting existing uninsulated standard unitary steel cross ties (12) to insulated steel cross ties (40), because the existing standard cross ties (12) can be easily modified without the need for repositioning mounting holes and adjusting for an added insulation layer between the stock rail (10) and the insulated cross ties (40).

Figure 4:
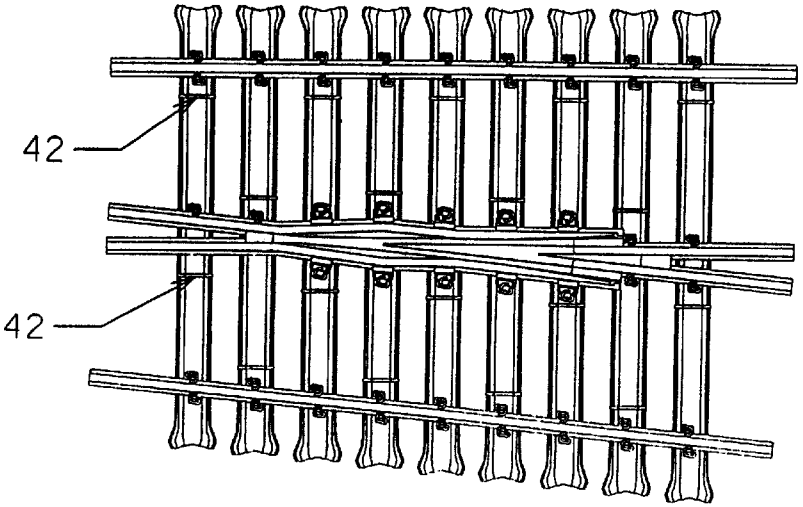
FIG. 4 is a plan view of a frog area with electrically insulated steel cross ties according to an embodiment of the invention.

FIG. 4 is a plan view of a frog area with insulated steel cross ties (40) according to an embodiment of the invention. Another advantage of the system taught by the invention is that for a cross tie (40) which is in contact with two stock rails (10), only one insulated joint (42) is required between these two stock rails (10). In the teachings of the prior art, two insulated joints are normally used, one between each stock rail (10) and the standard cross tie (12). Similarly, when the insulated cross tie (40) spans three stock rails (10) under the crossing at the frog area, only two insulated joints (42) are required, instead of the three which would be required to insulate all three stock rails (10) from the standard cross tie (12) using the prior art.

As shown by FIGS. 3 and 4, the insulated joints (42) are located near one of the stock rails (10) to minimize the forces acting on the insulated joint (42). In the preferred embodiment, the insulated joints (42) on consecutive cross ties (40) are near opposite stock rails (10). Where possible, the position of the insulated joint (42) is a pre-determined fixed distance from the end of the cross tie (40). This facilitates the interchangeability of elongated members (40*a*, 40*b*).

Figure 5:
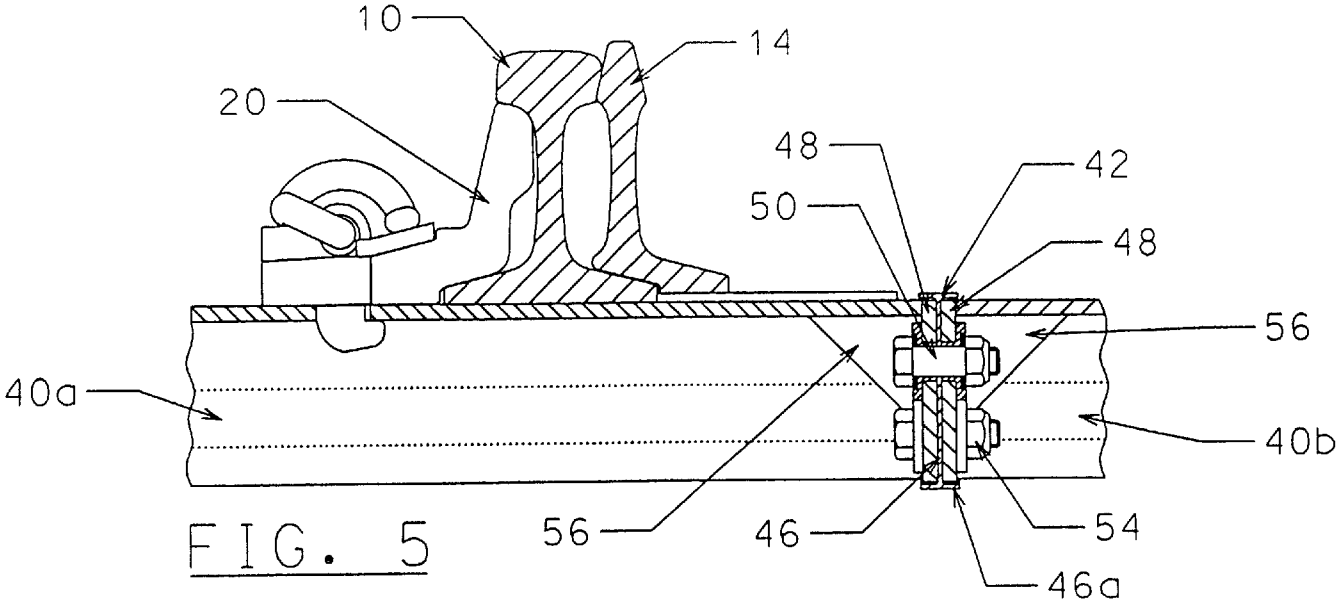
FIG. 5 is a partial section of an electrically insulated steel cross tie according to an embodiment of the invention near the switch point.

FIG. 5 is a partial section of an insulated steel cross tie (40) according to an embodiment of the invention near the switch blade (14). A standard rail brace (20) is used to hold the stock rail (10) in position. The insulated joint (42) is positioned a distance from the stock rail (10) to allow adequate room for the movement of the switch blade (14).

Figure 6:
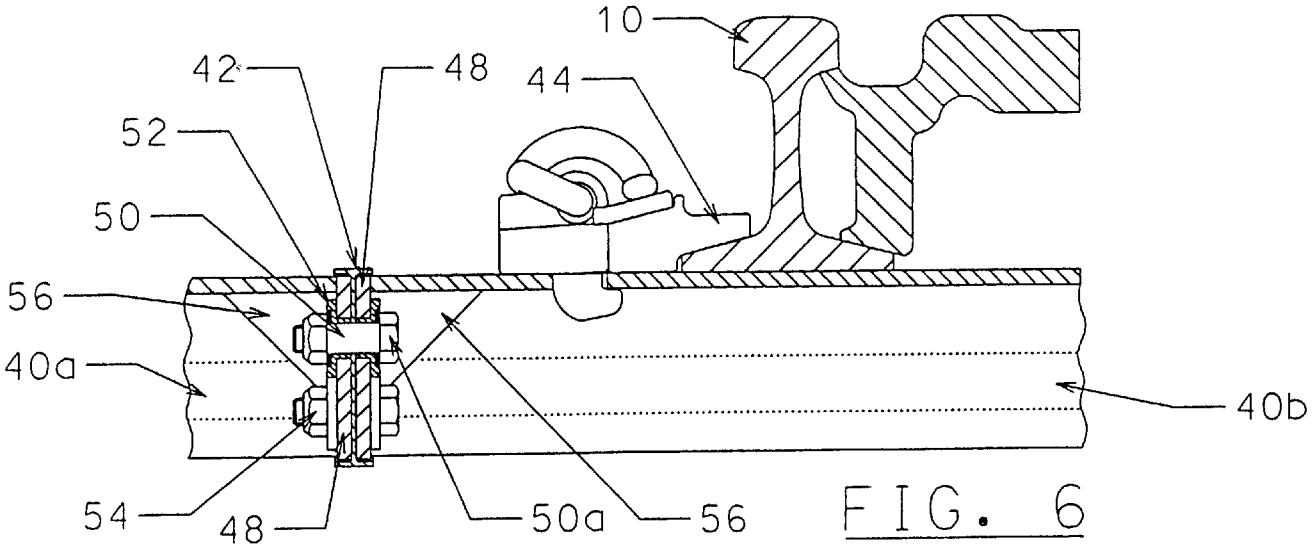
FIG. 6 is a partial section of an electrically insulated steel cross tie according to an embodiment of the invention at the frog section.

FIG. 6 is a partial section of an insulated steel cross tie (40) according to an embodiment of the invention near the frog clamp assembly. A standard frog clamp (44) is used to hold the stock rail (10) in position.

FIGS. 5 and 6 show how the insulator member (46) is interposed between the two cross tie elongated members (40*a*, 40*b*). FIGS. 5 and 6 also show how the flanges (46*a*) of the insulator member (46) surround the ends of the elongated members (40*a*, 40*b*), thereby preventing electrical current from being conducted from one elongated member to the other. In the preferred embodiment, the insulator member (46) covers the outward facing edges of the end plates (48) on both sides of the insulated joint (42).

Also depicted by FIGS. 5 and 6 is a section through one of the bolt fasteners (50). Flanged insulating sleeves (52) line the bolt hole thereby preventing the bolts (50) from conducting any electrical current between the elongated members (40*a*, 40*b*). In one embodiment, the flanged insulating sleeves (52) have hardened washers (58) embedded in the flange for contacting the bearing surfaces of the bolt head (50*a*) and nut (54).

FIGS. 5 and 6 show the gusset plates (56) which strengthen the insulated joint (42) by reinforcing and buttressing the end plates (48). In one embodiment the gusset plates (56) are welded to the end plates (48) and the respective elongated member (40*a*, 40*b*).

Figure 7:
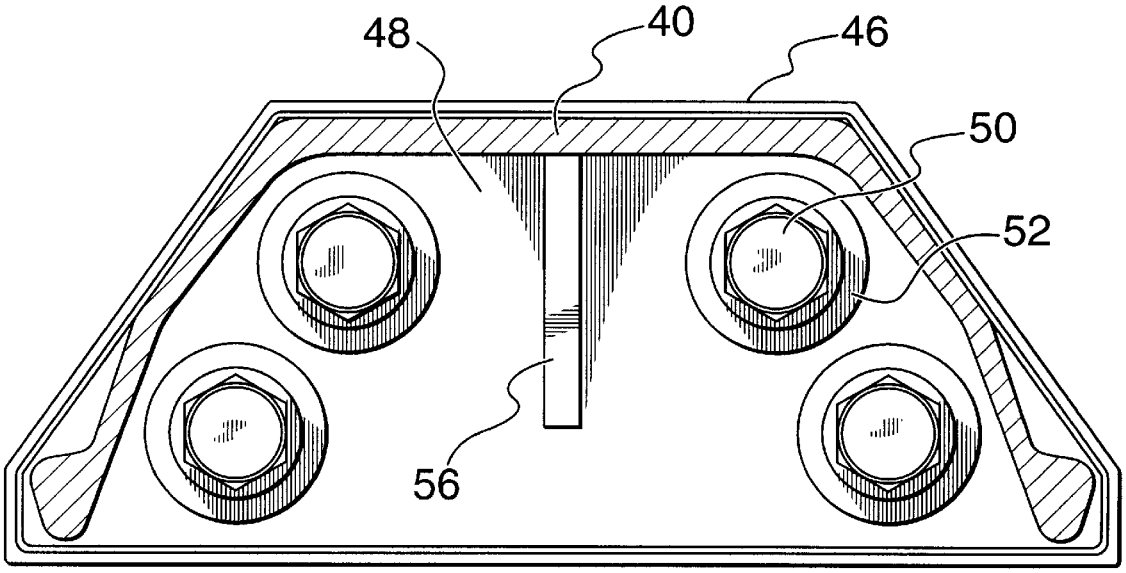
FIG. 7 is an end view of the assembled inside butt joint according to an embodiment of the invention.

FIG. 7 is an end view of the assembled inside butt joint (42) according to an embodiment of the invention. FIG. 7 shows how the end plate (48) is welded to the elongated member (40*a*, 40*b*) and the gusset plate (56). The heads of the bolts (50*a*) are prevented from contacting the end plate (48) by the flange of the insulating sleeve (52).

FIG. 7 shows how all of the bolt fasteners (54) are located on the inside of the elongated members (40*a*, 40*b*). Apart from the flanges (46*a*) of the insulator member (46), the exterior of the cross tie (40) has the same profile as a non-insulated cross tie (12). An advantage of this configuration is that the connector bolts (50) are shielded from rocks, tampering, and other dangers. The inside location of the connector bolts (50) also prevents the joint (42) from being a tripping hazard, as would be the case with an outside flanged connection.

FIG. 7 also shows a particular shape for the cross section of the cross tie elongated members (40*a*, 40*b*). The shape of the cross tie elongated members (40*a*, 40*b*) may change to ensure that the mechanical strength of the joint (42) is appropriate for the track applications and operating conditions. However, such changes in the shape of the cross tie (40) cross section would not result in any deviation from the spirit and scope of this invention.

FIGS. 5 through 7 show how the end plate (48) covers the ends of the elongated members (40*a*, 40*b*) without extending beyond the top surface of the elongated members (40*a*, 40*b*). This prevents the end plates (48) from becoming a tripping hazard. In one embodiment the end plates (48) are welded to the inside corners formed with elongated members (40*a*, 40*b*) and on the outside of the arms of the cross tie (40) where it diverges away from the end plate (48).

Figure 8B:
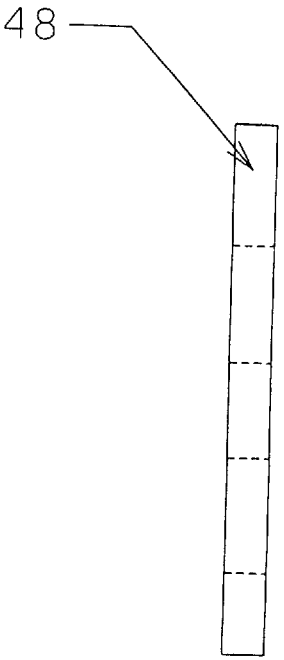
FIGS. 8*a* and 8*b* depict an end plate according to an embodiment of the invention
Figure 8A:
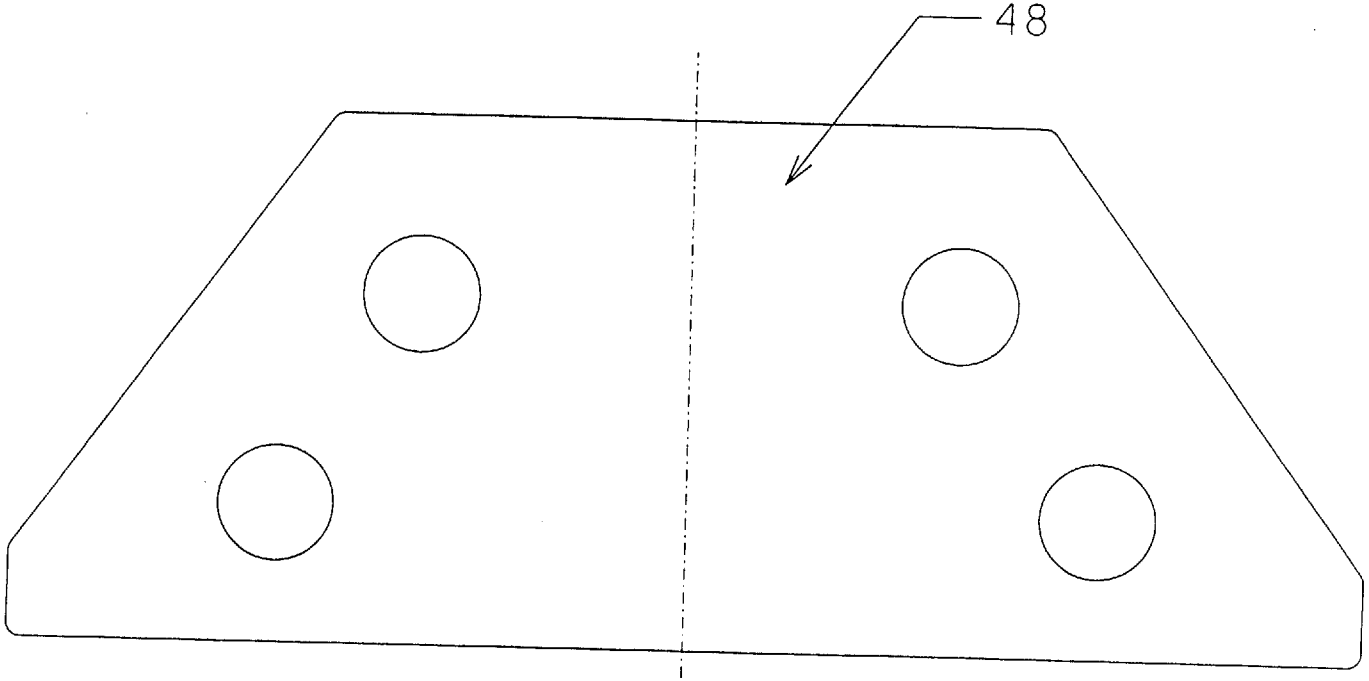

FIGS. 8*a* and 8*b* depict an end plate (48) according to one embodiment of the invention. The end plate (48) is made from mild steel which can be welded directly to the elongated members (40*a*, 40*b*). In one embodiment of the invention, the bolt holes are pre-drilled prior to welding the end plates (48) to the cross tie elongated members (40*a*, 40*b*). The end plate (48) is cut in the general shape of a bilaterally symmetrical trapezoid which is generally the same as the outline of the cross tie (40) cross section.

Figure 9B:
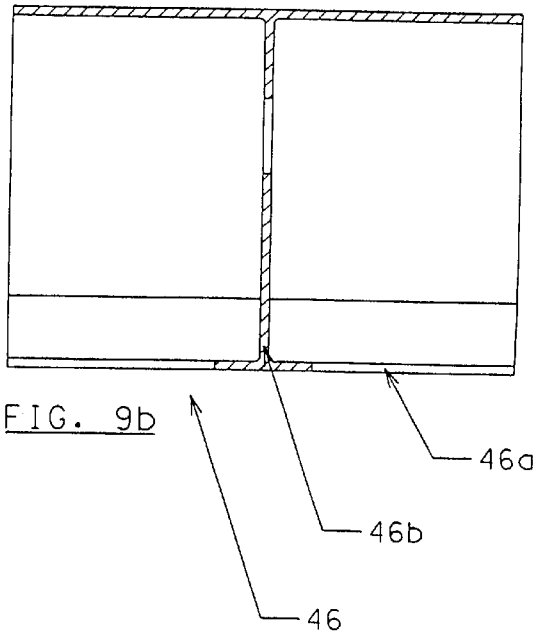
FIGS. 9*a* through 9*c* depict an electrical insulator member according to an embodiment of the invention.
Figure 9A:
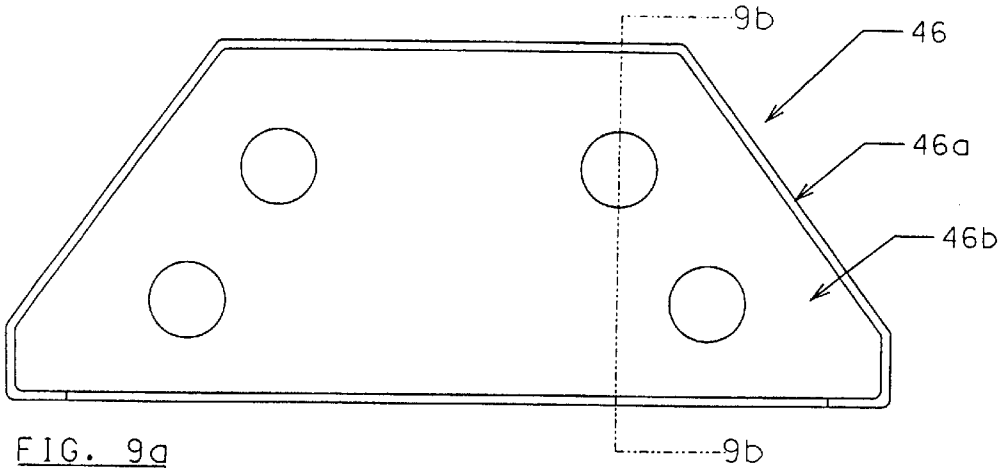
Figure 9C:
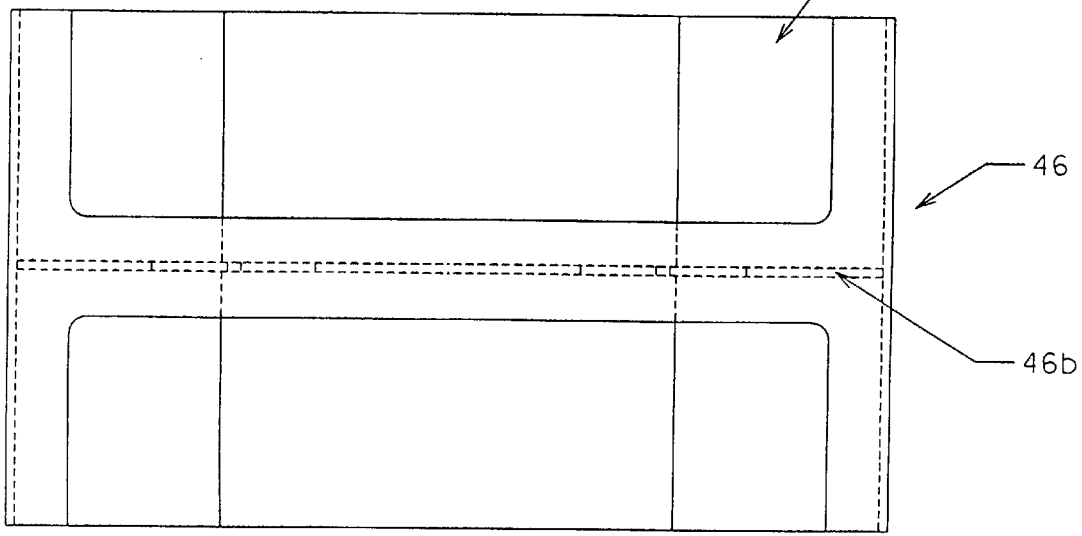

FIGS. 9*a* through 9*c* depict an insulator member (46) according to an embodiment of the invention. In the preferred embodiment, the web (46*b*) of the insulator member (46) generally matches the dimensions of the end plate (48) with an additional allowance for the flanges (46*a*) to overlap the outward facing edges of the end plates (48). The insulator member (46) can be made from any flexible electrically non-conductive material. Different materials can be chosen depending on the axle loads, ballast, climatic conditions, or other service conditions. In one embodiment insulator member (46) is made from a urethane composite.

FIG. 9*c* is a bottom view of the insulator member (46). The lower flange is not as wide as the flange on the sides and top. The elongated members (40*a*, 40*b*) are open at the bottom, so there is no need for a wide flange on the bottom. Also, the narrower flange on the bottom allows better access to the bolts (50) and nuts (54) shown in FIGS. 7, 13*a* and 13*b*.

Figure 10B:
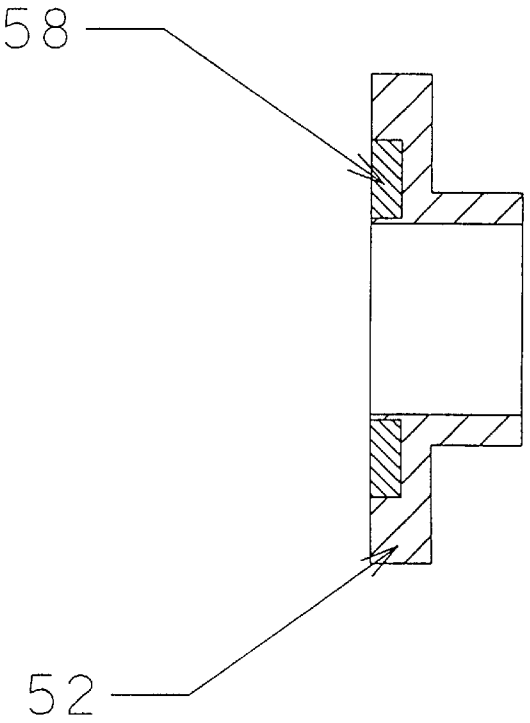
FIGS. 10*a* and 10*b* depict a composite insulating sleeve according to an embodiment of the invention.
Figure 10A:
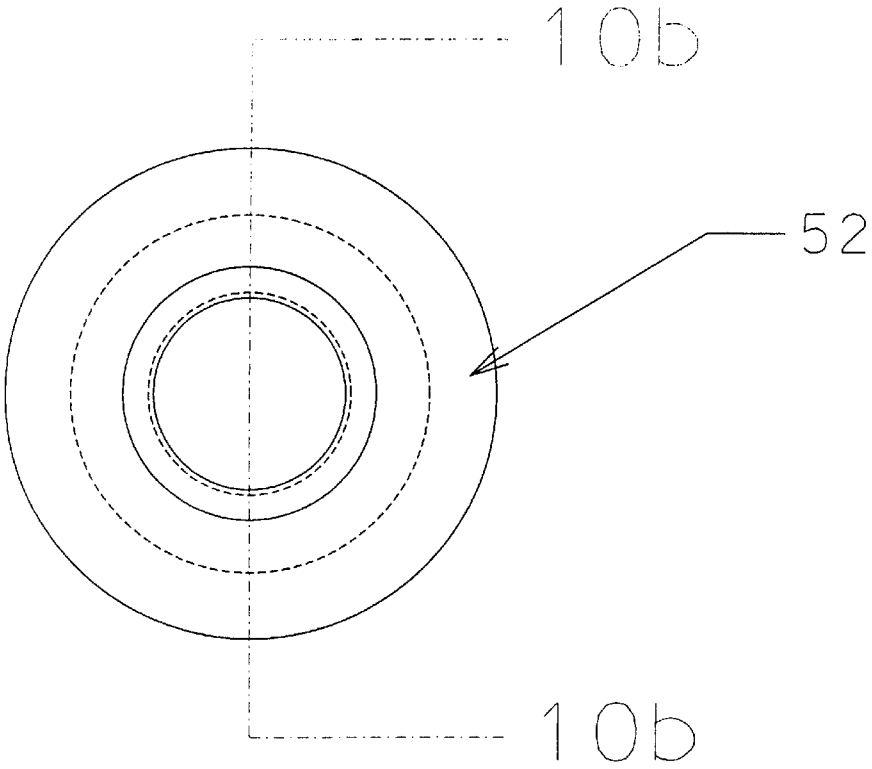

FIGS. 10*a* and 10*b* depict a composite flanged insulating sleeve (52) according to one embodiment of the invention. The flange covers the area of the end plate (48) where the nut (54) or the head (50*a*) of the bolt (50) bears against the end plate (48). A washer (58) is bonded to and embedded in the flange. In one embodiment of the invention, the washer (58) is made from hardened steel and the insulating sleeve (52) is made from urethane. The washer (58) prevents the bolt (50) or nut (54) from damaging the insulating sleeve (52).

Figure 11B:
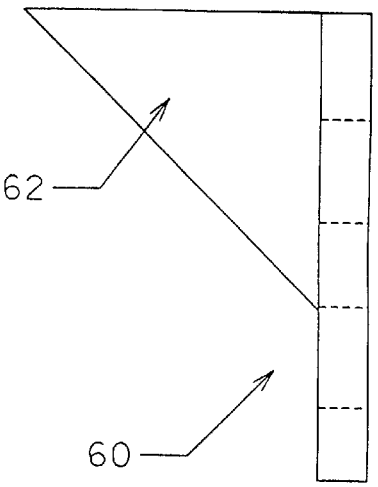
FIGS. 11*a* and 11*b* depict a cast steel end plate according to a preferred embodiment of the invention.
Figure 11A:
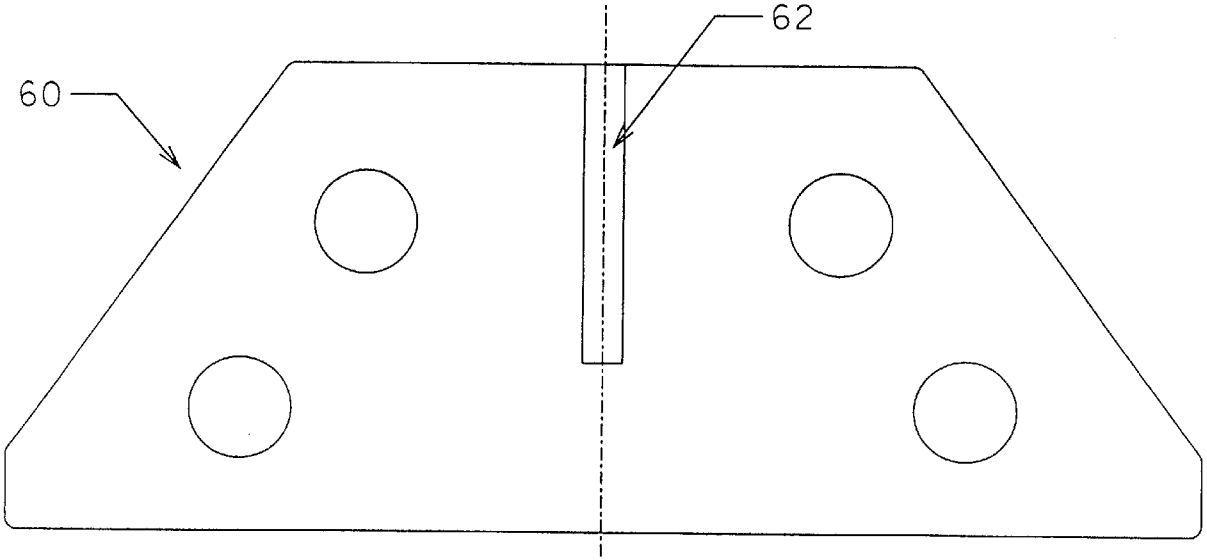

FIGS. 11*a* and 11*b* depict an end plate (48) according to the preferred embodiment of the invention. The end plate (60) is made from one solid piece of cast steel which is cast in the shape shown in FIGS. 11*a* and 11*b*. The end plate (60) is cast with an integral support gusset (62) and bolt holes. The end plate (60) is welded directly to the elongated members (40*a*, 40*b*).

Figure 12B:
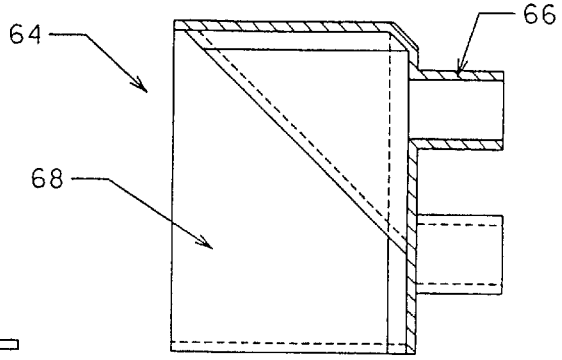
FIGS. 12*a* through 12*c* depict an inner insulator piece according to a preferred embodiment of the invention.
Figure 12A:
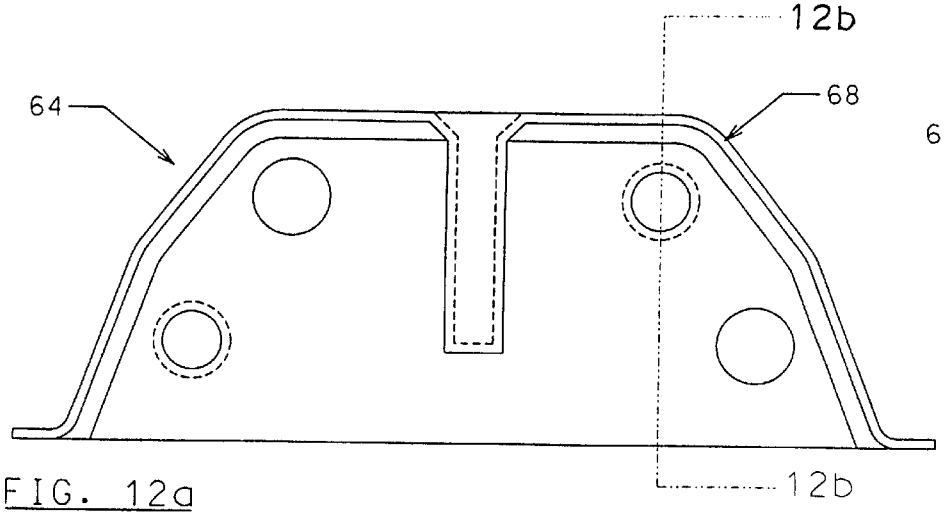
Figure 12C:
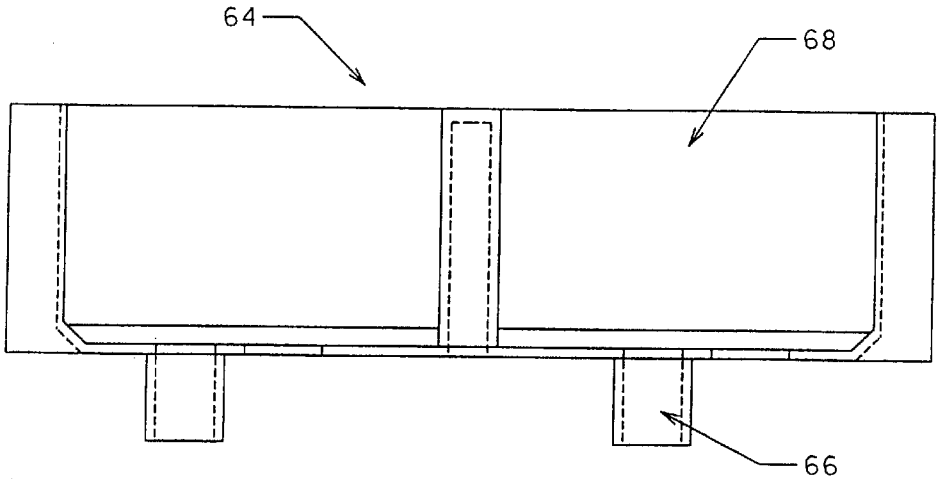

FIGS. 12*a* through 12*c* depict an inner insulating member (64) according to the preferred embodiment of the invention. The inner insulating member (64) substitutes for the individual flanged insulating sleeves (52) shown in detail in FIGS. 10*a* and 10*b*. Instead of using flanged insulating sleeves (52) to insulate the bolt (50) and nut (54) from the elongated members (40*a*, 40*b*), the inner insulating member (64) covers the entire inner face of the end plate (48, 60). The inner insulating member (64) is moulded with integral bolt hole liners (66) to match the bolt hole pattern of the end plate to insulate the stem of the bolts (50) from the end plate (48, 60). In one embodiment of the invention, the inner insulating member (64) has flanges (68) which cover part of the inner surface of the elongated members (40*a*, 40*b*) next to the end plate (48, 60). In one embodiment of the invention, the inner insulating member (64) also covers the support gusset (56, 62).

Figure 13B:
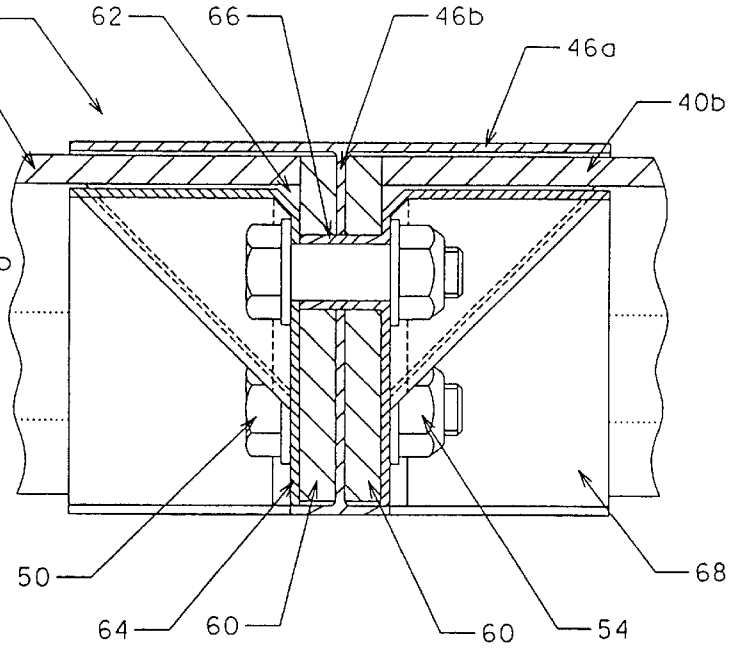
FIGS. 13*a* and 13*b* depict sectional views of an insulated cross tie featuring a cross tie joint according to a preferred embodiment of the invention.
Figure 13A:
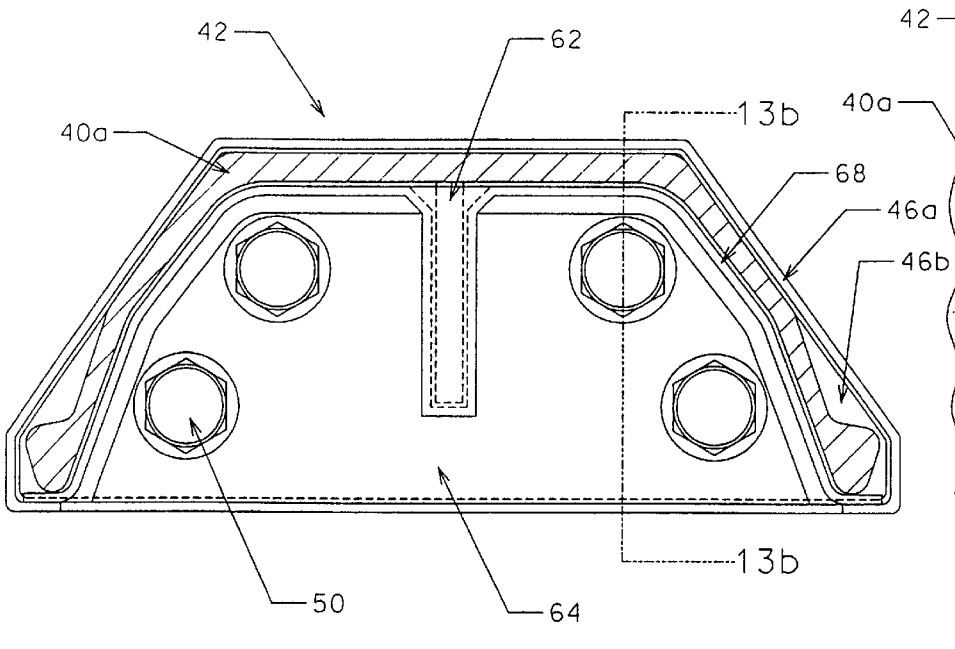

FIG. 13*a* depicts a sectional view of an elongated member (40*a*, 40*b*) facing an insulated joint (42) according to the preferred embodiment of the invention. The inner insulating member (64) covers essentially all of the inner surface of the end plate (60), including the support gusset (62). The bolts (50) are insulated from the end plate (60) and the elongated members (40*a*, 40*b*) by the inner insulating member (64).

FIG. 13*b* depicts a sectional view of the insulated joint (42) according to the preferred embodiment of the invention. The insulating member (46) electrically insulates the adjacent end plates (60) from each other.

Uninsulated standard steel cross ties (12) are still used for turnouts which do not have track circuit systems. If the turnout is later upgraded by installing track circuit systems, using the method taught by this invention, it is possible to convert the uninsulated standard steel cross ties (12) into the insulated steel cross ties (40) taught by this disclosure.

A method of converting non-insulated standard steel cross ties (12) into insulated steel cross ties (40) according to an embodiment of the invention is as follows:

1. An uninsulated standard steel cross tie (12) is transversely cut across its section at a predetermined location.
2. Cast steel end plates (60) with cast support gussets (62) and bolt holes, are welded to each of the cut ends of the cross tie elongated members (40*a*, 40*b*).
3. Bare steel in and around the joint (42) may be coated with an insulating epoxy spray.
4. The two elongated members (40*a*, 40*b*) are rejoined with an insulator member (46) positioned therebetween.
5. The insulated cross tie (40) is bolted together using flanged insulating sleeves (52) to insulate the bolts (50).
6. The insulated cross tie (40) is inspected and the outer ends of the insulated cross tie (40) can be crimped down or spaded, if not already spaded. Spading is done to hold the ballast in place.

If the insulated cross tie (40) will span more than two stock rails (10), additional insulated joints (42) can be added at locations in between where the stock rails (10) will be attached to the insulated cross tie (40).

The conversion method described above can be carried out without any special tools so it can be done at or near the site of the existing installation.

Instead of using cast steel end plates (60) as set out in the step of paragraph number 2 above, end plates (48) can be fabricated from steel plate.

The same method can be used to fabricate insulated steel cross ties (40) for new installations. Of course, new insulated cross ties (40) can be manufactured more efficiently and on a larger scale in the controlled environment of a fabrication facility.

As will be apparent to those skilled in the art in the light of the foregoing disclosure, many alterations and modifications are possible in the practice of this invention without departing from the spirit or scope thereof. For example, the embodiments of the invention have been described in relation to cross ties made from steel. Other metals or electrically conductive composite materials could be substituted for steel without departing from the spirit and scope of this invention.

Accordingly, the scope of the invention is to be construed in accordance with the substance defined by the following claims.

What is claimed is:

1. An electrically insulated railway cross tie for use in a railway track system, said cross tie comprising:

a first elongated electrically conductive metal member;

a second elongated electrically conductive metal member having a longitudinal axis aligned with said first elongated member;

an insulating member electrically insulating said first elongated member from said second elongated member, said insulating member having flanged edges which overlap facing ends of said first and second elongated members, said insulating member being interposed between facing axial ends of said first and second elongated members; and a connection means for releasably connecting said insulating member and said first elongated member and said second elongated member, thereby making said cross tie a structural unit, said connection means being electrically insulated to prevent said connection means from conducting electrical current between said first and second elongated members; said connection means comprising:

a bolt assembly including:

a bolt with a threaded stem inserted through aligned bolt holes in said first elongated member, said insulator member, and said second elongated member; and a locking nut fitted on said threaded stem of said bolt; and an electrically insulating liner located between said bolt assembly, and said first and second elongated members, wherein said liner prevents said connector assembly from conducting electrical current between said first and second elongated members.

2. The electrically insulated railway cross tie of claim 1 further including an end plate attached to opposing ends of said first and second elongated members respectively.

3. The electrically insulated railway cross tie of claim 2 wherein said bolt holes in said first and second elongated members are positioned on said end plate.

4. The electrically insulated railway cross tie of claim 3 wherein said insulating member is a first insulating member and said insulating liner is a second insulating member for electrically isolating said bolt assembly from said first and second end plates, said second insulating member comprising:

a web portion for covering an inward facing surface of said first end plate; and a sleeve attached to said web portion, for lining a bolt hole through said first and second end plates.

5. The electrically insulated railway cross tie of claim 4 further including a third insulating member comprising:

a web portion for covering an inward facing surface of said second end plate; and a sleeve attached to said web portion, for lining a bolt hole through said first and second end plates.

6. The electrically insulated railway cross tie of claim 5 wherein said second and third insulating members further comprise flanges attached to edges of respective said web portions for covering said elongated members adjacent to said respective first and second end plates.

7. The electrically insulated railway cross tie of claim 1 wherein said insulating liner is an electrically insulating sleeve with a flange, said sleeve lining said bolt hole and said flange extending from the perimeter of said bolt hole to prevent bearing surfaces of said bolt head and said nut from contacting said first and second elongated member respectively.

8. The electrically insulated railway cross tie of claim 7 wherein said flange of said insulating sleeve has a hardened washer embedded in said sleeve whereby said bolt head and said nut contact said washer when said nut is tightened.

9. The electrically insulated railway cross tie of claim 1 further including an end plate associated with each of facing ends of said first and second elongated members.

10. The electrically insulated railway cross tie of claim 1 further including an end plate associated with each of said facing ends of said first and second elongated members, and a gusset plate attached to said end plates and respective said first and second elongated members for reinforcing the attachment of said end plates to said respective first and second elongated members.

11. The electrically insulated railway cross tie of claim 1 wherein said insulating member is made from a polyurethane composite.

12. An electrically insulated railway cross tie for use in a railway track system, said cross tie comprising:

a first elongated member;

a second elongated member having a longitudinal axis aligned with said first elongated member;

a first insulating member electrically insulating said first elongated member from said second elongated member, said insulating member having flanged edges which overlap facing ends of said first and second elongated members; and a connector assembly for releasably joining said first elongated member to said second elongated member with said fist insulating member therebetween, said connector assembly comprising a second insulating member including an electrically insulating sleeve with a flange at each end, said insulating sleeve lining said connector assembly to prevent said connector assembly from contacting said first and second elongated members respectively.

13. The electrically insulated railway cross tie of claim 12 wherein said connector assembly comprises:

a bolt assembly including:

a bolt with a threaded stem inserted through aligned bolt holes in said first elongated member, said insulating member, and said second elongated member; and a locking nut fitted on said threaded stem of said bolt.

14. The electrically insulated railway cross tie of claim 13 wherein said flange of said insulating sleeve has a hardened washer embedded in said sleeve whereby a head of said bolt and said nut contact said washer when said nut is tightened.

15. An electrically insulated railway cross tie for use in a railway track system, said cross tie comprising:

a first elongated member;

a second elongated member having a longitudinal axis aligned with said first elongated member;

an insulating member electrically insulating said elongated member from said second elongated member, said insulating member having flanged edges which overlap facing ends of said first and second elongated members; and a connection means for connecting said first elongated member to said second elongated member with said insulating member therebetween, thereby making said cross tie a structural unit, said connection means comprising a connector assembly, said connector assembly including an electrically insulating liner located between said connector assembly and said first and second elongated members, wherein said liner prevents said connector assembly from conducting electrical current between said first and second elongated members.

16. The electrically insulated railway cross tie of claim 15 wherein said connector assembly comprises:

a bolt assembly including:

a bolt with a threaded stem inserted through aligned bolt holes in said first elongated member, said insulator member, and said elongated member; and a locking nut fitted on said threaded stem of said bolt.

17. The electrically insulated railway cross tie of claim 16 further including an end plate associated with each of facing ends of respective said first and second elongated members.

18. The electrically insulated railway cross tie of claim 17 wherein said insulating member is a first insulating member and said insulating liner is a second insulating member for electrically isolating said bolt assembly from said first and second end plates, said second insulating member comprising:

a web portion for covering an inward facing surface of said first end plate; and a sleeve attached to said web portion, for lining a bolt hole through said first and second end plates.

19. The electrically insulated railway cross tie of claim 18 further including a third insulating member comprising:

a web portion for covering an inward facing surface of said second end plate; and a sleeve attached to said web portion, for lining a bolt hole through said first and second end plates.

20. The electrically insulated railway cross tie of claim 19 wherein said second and third insulating members further comprise flanges attached to edges of respective said web portions for covering said elongated members adjacent to respective said first and second end plates.

21. The electrically insulated railway cross tie of claim 20 further including a gusset plate attached to said end plates and respective said first and second elongated members for reinforcing the attachment of said end plates to said respective first and second elongated members.

22. The electrically insulated railway cross tie of claim 21 wherein said insulating member is made from a polyurethane composite.

* * * * *

UNITED STATES PATENT AND TRADEMARK OFFICE

CERTIFICATE OF CORRECTION

PATENT NO. : 5,918,806
DATED : July 6, 1999
INVENTOR(S) : Sean Keightley, et al.

It is certified that error appears in the above-identified patent and that said Letters Patent is hereby corrected as shown below:

Title page,
Item [73], the correct name of the assignee is:

"North American Railway Steel Tie Corporation"

Signed and Sealed this

Ninth Day of October, 2001

*Attest:*

Nicholas P. Godici

*Attesting Officer*

NICHOLAS P. GODICI
*Acting Director of the United States Patent and Trademark Office*